US011215177B2

(12) United States Patent
Borchers et al.

(10) Patent No.: US 11,215,177 B2
(45) Date of Patent: Jan. 4, 2022

(54) VANE PUMP AND METHOD FOR THE OPERATION THEREOF

(71) Applicant: Magna Powertrain Bad Homburg GmbH, Bad Homburg (DE)

(72) Inventors: Dirk Borchers, Oberursel (DE); Thomas Dippel, Neustadt (DE)

(73) Assignee: HANON SYSTEMS EFP DEUTSCHLAND GMBH, Bad Homburg (DE)

( * ) Notice: Subject to any disclaimer, the term of this patent is extended or adjusted under 35 U.S.C. 154(b) by 481 days.

(21) Appl. No.: 15/577,363

(22) PCT Filed: May 23, 2016

(86) PCT No.: PCT/EP2016/061611
§ 371 (c)(1),
(2) Date: Nov. 28, 2017

(87) PCT Pub. No.: WO2016/193043
PCT Pub. Date: Dec. 8, 2016

(65) Prior Publication Data

US 2018/0149154 A1 May 31, 2018

(30) Foreign Application Priority Data

Jun. 2, 2015 (DE) ..... 10 2015 210 209.2

(51) Int. Cl.
*F04C 2/344* (2006.01)
*F01C 21/08* (2006.01)
(Continued)

(52) U.S. Cl.
CPC ..... *F04C 2/3446* (2013.01); *F01C 21/0836* (2013.01); *F01C 21/0863* (2013.01);
(Continued)

(58) Field of Classification Search
CPC ..... F01C 21/0836; F01C 21/0863; F01C 21/108; F01C 21/0827; F04C 14/06;
(Continued)

(56) References Cited

U.S. PATENT DOCUMENTS 3,473,478 A 10/1969 Little, Jr.
5,328,337 A * 7/1994 Kunta ..... F04C 2/3446 417/310
(Continued)

FOREIGN PATENT DOCUMENTS

CN 203335393 U 12/2013
CN 103842656 A 6/2014
(Continued)

OTHER PUBLICATIONS

English Machine Translation of EP2257693B1. Translated from Espacenet on Oct. 23, 2020. (Year: 2015).*
(Continued)

*Primary Examiner* — Mary Davis
*Assistant Examiner* — Paul W Thiede
(74) *Attorney, Agent, or Firm* — Dickinson Wright PLLC

(57) ABSTRACT

A vane cell pump comprises a contour ring having an inner peripheral face and a rotatable rotor which has a plurality of conveying elements displaceable radially relative to a rotation axis. The inner peripheral face includes a plurality of pump portions each constructed with an intake region and a pressure region which are passed through by the conveying elements during rotation of the rotor. A narrow location at which the conveying elements are displaced radially inward toward the rotation axis to a greatest extent, is located between a pressure region and a subsequent intake region. By applying a part-stroke, an auxiliary start contour which is arranged between the rotation axis and the inner peripheral face radially inside the conveying elements in the region
(Continued)

of at least one pump portion displaces the conveying elements to the greatest extent radially inwardly.

10 Claims, 9 Drawing Sheets

(51) Int. Cl.
*F04C 14/06* (2006.01)
*F01C 21/10* (2006.01)

(52) U.S. Cl.
CPC ..... *F01C 21/108* (2013.01); *F04C 14/06* (2013.01); *F04C 2240/20* (2013.01); *F04C 2270/701* (2013.01)

(58) Field of Classification Search
CPC ..... F04C 2240/20; F04C 2270/701; F04C 2/3446; F04C 2240/801; F04C 2/344; F04C 14/18; F04C 18/20
USPC ..... 418/260, 261, 264; 417/62, 310; 29/888.025
See application file for complete search history.

(56) References Cited

U.S. PATENT DOCUMENTS

| | | | | |
|---|---|---|---|---|
| 6,030,195 | A * | 2/2000 | Pingston | F01C 21/0863 418/133 |
| 6,203,303 | B1 * | 3/2001 | Fujiwara | F01C 21/0863 418/268 |
| 6,634,876 | B2 * | 10/2003 | Osugi | F01C 21/0827 29/888.025 |
| 6,877,969 | B2 * | 4/2005 | Yao | F01C 21/0863 418/133 |
| 2003/0044300 | A1 | 3/2003 | Osugi et al. | |
| 2009/0180913 | A1 * | 7/2009 | Kimberlin | F01C 21/0836 418/261 |
| 2014/0234150 | A1 | 8/2014 | Sugihara et al. | |

FOREIGN PATENT DOCUMENTS

| | | | | |
|---|---|---|---|---|
| DE | 1751462 | A1 | 3/1971 | |
| DE | 102013214926 | A1 | 6/2014 | |
| DE | 102014212022 | A1 | 1/2015 | |
| DE | 102013221701 | A1 | 4/2015 | |
| EP | 2257693 | B1 | 10/2015 | |
| JP | 2003065247 | A | 3/2003 | |
| JP | 2005120893 | A * | 5/2005 | |
| WO | WO-03056180 | A1 * | 7/2003 | F04C 2/3446 |
| WO | WO2012079573 | A2 | 6/2012 | |

OTHER PUBLICATIONS

English Machine Translation of CN203335393U (Year: 2013).*
International Search Report and Written Opinion dated Jul. 21, 2016 from International Patent Application No. PCT/EP2016/061611 (with English translation of International Search Report).
Search Report dated Aug. 24, 2018 from corresponding Chinese Patent Application No. 2016800319461.

* cited by examiner

VANE PUMP AND METHOD FOR THE OPERATION THEREOF

CROSS-REFERENCE TO RELATED APPLICATIONS

This application is a National Stage of International Application No. PCT/EP2016/061611, filed May 23, 2016, which claims priority to German Application No. 102015210209.2 filed Jun. 2, 2015. The entire disclosure of each of the above applications is incorporated herein by reference.

FIELD OF THE INVENTION

The invention relates to a vane cell pump comprising a hollow-cylindrical contour ring which is arranged between two side plates and which has an inner peripheral face and a rotor which is rotatably supported about a rotation axis which extends parallel with the cylinder axis of the contour ring and which has a plurality of conveying elements which can be displaced radially relative to the rotation axis and which are urged against the inner peripheral face during a rotation of the rotor and a method for the operation thereof, which provides for at least the conveying elements which are still completely moved in during a rotation of the rotor after the introduction thereof into a pump portion in order to forcibly redirect a part-stroke in the direction toward the inner peripheral face of the contour ring.

BACKGROUND OF THE INVENTION

This section provides background information related to the present disclosure which is not necessarily prior art.

It is known to provide vane cell pumps which are also known as rotary vane cell pumps as hydraulic pumps, for example, as lubrication oil pumps in vehicle applications, inter alia since these can be constructed in a structurally simple, multi-flow, for example, dual-flow manner so as to be able to be switched in accordance with temperature. This has the advantage that with a high lubrication oil requirement, for example, at high temperatures, a plurality of flows of a vane cell pump convey the lubrication oil under pressure. For example, this is preferably carried out with gear mechanisms, such as drive mechanisms, which require a gear oil pump for supplying their hydraulic functions such as clutch actuation, converter supply or cooling and lubrication of the gear components. In this instance, this may involve, for example, both conventional automatic gears which are also referred to as stepped automatic transmissions or modern dual-clutch transmissions.

A single or multi-flow vane cell pump comprises a rotor which is rotatably supported about a rotation axis and which is connected or can be connected to an output shaft, for example, of a gear mechanism or an engine, such as an internal combustion engine or an electric motor, and a hollow-cylindrical contour ring which is arranged between two side plates and which has an inner peripheral face whose cylinder axis extends parallel with the rotation axis, for example, coincides with the rotation axis. The rotor has a plurality of conveying elements which can be displaced radially relative to the rotation axis and which in the event of a rotation of the rotor are urged against the inner peripheral face. This face is formed in such a manner that a number corresponding to the number of flows of preferably sickle-like conveying chambers which each form a pump portion and which each have an intake and a pressure region are formed. The conveying elements pass through these in the event of a rotation of the rotor. Within a pump portion, the radial spacing between the rotation axis and the inner peripheral face of the contour ring continuously increases when viewed in the working rotation direction of the rotor of the vane cell pump over the intake region initially as far as approximately the center of the pump portion in order subsequently to continuously decrease again as far as the end of the pressure region. Between a pressure region and an intake region which follows when viewed in the working rotation direction of the vane cell pump there is a narrow location at the passage of which the conveying elements are most significantly displaced radially inward in the direction toward the rotation axis. Fluid connections, via which the vane cell pump conveys, in particular draws in, a fluid, such as lubrication oil, for example, from a sump, and pumps it to consumers and/or consumer locations, for example, within a gear mechanism, each open in an intake region or emerge from a pressure region.

DE 10 2013 214 926 A1 and DE 10 2014 212 022 A1 disclose so-called hydraulic vane cell pumps in which the rotor has radially inside the conveying elements expulsion regions which are connected at least partially to at least one pressure region by means of a fluid path. There is used as a fluid path, for example, one or more so-called under-vane grooves which are formed in one or both side plates and by means of which the expulsion regions are in fluid connection with at least one pressure region in order to expel the conveying elements when the vane cell pump is started up. The conveying elements are during operation of the vane cell pump driven radially outward not only by the centrifugal forces acting as a result of the rotor rotation, but also in a state supported by the pump pressure which is present over the fluid path in the expulsion regions so that they run close to the inner peripheral face of the contour ring.

If the fluid conveyed by a hydraulic vane cell pump, for example, a hydraulic or lubrication oil, becomes cold, the viscosity thereof increases so that the movability of the conveying elements decreases. If the vane cell pump is subsequently operated again, the conveying elements, which have come to rest during the cooling between a pressure region of a first pump portion and an intake region of a second pump portion of a multi-flow pump or with a single-flow pump when viewed in the working rotation direction of the vane cell pump between the pressure region and the intake region of the only one pump portion, remain in the position thereof urged radially inward in the direction toward the rotation axis by the inner peripheral face of the contour ring. If conveying elements which have come to rest during the cooling in a state urged radially inward in a narrow location in the direction toward the rotation axis or in the case of cooled fluid conveying elements which have been urged radially inward by a narrow location in the direction toward the rotation axis pass a pump portion which is adjacent in the working rotation direction, a short-circuit is quasi produced therein, with at best significantly reduced conveying capacity. This short-circuit further prevents a pressure build-up which is necessary to urge the conveying elements radially outward against the inner peripheral face of the contour ring in the pump portion which adjoins a narrow location in the working rotation direction.

If an above-described hydraulic vane cell pump is further arranged in such a manner that the rotation axis thereof extends in a substantially horizontal direction, the conveying elements which are located at the top further slide as a result of gravitational force into the receiving members thereof which are provided in the rotor when the pump is shut down at operating temperature. Any separation between the intake region and pressure region provided by conveying elements in an upper pump portion is thereby additionally dispensed with. As a result of gravitational force, the lower conveying elements remain in contact with the inner peripheral face of the contour ring so that in a where applicable lower pump portion the intake and pressure regions are separated by the moved-out conveying elements. In the upper pump portion, during restarting, there is consequently directly a short-circuit, directly followed by the effect described above, in which the conveying elements which have entered from the narrow location between the pressure region and intake region the pump portion adjacent in the working rotation direction of the vane cell pump also produce a short-circuit therein as a result of not being expelled. This results in the already significantly limited conveying capacity and resultant pressure build-up almost completely coming to a standstill.

Furthermore, there may occur more difficult operating conditions which additionally arise in combination with the regularly occurring cold start of a hydraulic vane cell pump with highly viscous oil and which can thereby exacerbate this.

A first difficult operating condition is a cold start after previous air intake. In this instance, a hydraulic vane cell pump which is installed in a vehicle starts in a cold state. The vehicle is subsequently moved only briefly so that the hydraulic or lubrication oil is not heated and thereby remains highly viscous. The vane cell pump draws air in this instance, for example since the vehicle is passing over a ramp or is standing on a slope, and is then directly switched off again. In the intake and/or pressure regions of the vane cell pump, and in connected intake and/or pressure chambers, large quantities of air can thereby accumulate.

A second difficult operating condition involves restarting a hydraulic vane cell pump which is driven by a fixedly coupled output shaft of a periodically operating thermal engine, wherein in the event of the above deactivation, as a result of the periodic nature of the thermal engine, an unintentional blowback occurs, together with a backward rotation of the vane cell pump. Conveying elements which have already entered a narrow location with the deactivation and which have already thereby been pressed back in the direction toward the rotation axis are moved back into the previous pump portion. Conveying elements which are located in a pump portion are also moved back in the direction of a previous narrow location and thereby moved in again. A short-circuit thereby occurs in all the pump portions of the vane cell pump which becomes evident with the subsequent cooling of the fluid.

A third difficult operating condition involves restarting an electromotively driven hydraulic vane cell pump which is controlled as required and which has previously been operated for the purposes of moving in the conveying elements intentionally with backward rotation and/or driven with unintentional slow rotation and/or depending on requirements is intended to be operated at a low speed.

A disadvantage with hydraulic vane cell pumps in which the expulsion of the conveying elements against the inner peripheral face of the contour ring takes place exclusively with hydraulic support of the action of centrifugal force is the unsatisfactory conveying capacity thereof when starting up under the difficult operating conditions set out, including restarting after the fluid has cooled.

DE 1751462 A1 discloses a forced guiding of the conveying elements of a vane cell pump between the inner peripheral face of the contour ring and a control cam which is arranged in the direction toward the rotation axis. The control cam has a contour which is similar to the inner peripheral face of the contour ring in a mathematical sense. In this instance, in each rotation angle of the rotor when viewed from the rotation axis relative to the inner peripheral face of the contour ring, there is the same spacing between the control cam and inner peripheral face. The conveying elements comprise resilient elements which clamp them in this consistent spacing between the inner peripheral face and the control cam. The conveying elements are thus forcibly guided over the entire radial stroke movement thereof, wherein in the event of a rotation of the rotor both in each pump portion and at each narrow location they are in abutment both with the inner peripheral face and with the control cam. The disadvantage of this is the high degree of wear as a result of the clamping forces acting constantly between the control cam and conveying elements and between the conveying elements and the inner peripheral face of the contour ring. Furthermore, the service-life is significantly limited as a result of the resilient elements which are used, such as, for instance, elastomer materials.

U.S. Pat. No. 3,473,478 discloses a vane cell pump whose conveying elements which can be radially displaced in the rotor are resiliently loaded against the inner peripheral face of the contour ring by means of an elastomer ring which is arranged inside the rotor. The disadvantage of this is the limited service-life as a result of ageing of the elastomer ring.

DE 10 2013 221 701 A1 discloses a vane cell pump in which the rotor has, radially inside the conveying elements, expulsion regions which are connected at least partially to at least one pressure region via a fluid path. In addition, there is provided a clamping ring which always presses the conveying elements radially outward against the inner peripheral face of the contour ring so that they also run tightly against the inner peripheral face of the contour ring in the case of a cold start. A disadvantage therein involves friction losses which are increased in comparison with an exclusively hydraulic expulsion of the conveying elements against the inner peripheral face of the contour ring during continuous operation in conjunction with an increased level of wear because the conveying elements are resiliently loaded by the clamping ring against the inner peripheral face of the contour ring in addition to the centrifugal force and in addition to the pump pressure. Furthermore, the service-life which is limited only by occurrences of fatigue of the clamping ring is disadvantageous.

EP 2257693B1 discloses a vane cell pump which is distinguished in that a starting under-vane supply region has a closed volume with a starting under-vane deployment portion as long as the vane(s) in the starting under-vane deployment portion is/are not yet deployed.

SUMMARY OF THE INVENTION

This section provides a general summary of the disclosure, and is not a comprehensive disclosure of its full scope or all of its features.

An object of the invention is to develop a hydraulic vane cell pump which can be operated in an energy-saving manner with a simple constructional structure and a high level of operational reliability under any operating conditions and a method which ensures an energy-saving operation of a structurally simply constructed vane cell pump which is reliable under any operating conditions.

The object is achieved by the features of one of the independent claims. Advantageous embodiments are set out in the dependent claims, the drawings and in the following description, including the description belonging to the drawings.

Accordingly, the invention first relates to a hydraulic vane cell pump.

It comprises a rotor which is rotatably supported about a rotation axis and a hollow-cylindrical contour ring which is arranged between two side plates and which has an inner peripheral face whose cylinder axis extends parallel with the rotation axis. The rotor has a plurality of conveying elements which can be displaced radially relative to the rotation axis and which are urged against the inner peripheral face during a rotation of the rotor. The inner peripheral face is formed in such a manner that a number corresponding to the number of flows of preferably sickle-like conveying chambers which each form a pump portion are each constructed with an intake region and a pressure region. They are passed through by the conveying elements during a rotation of the rotor. Within a pump portion, the radial spacing between the rotation axis and the inner peripheral face of the contour ring continuously increases when viewed in the working rotation direction of the rotor of the vane cell pump over the intake region initially as far as approximately the center of the pump portion in order subsequently to continuously decrease toward the end of the pressure region again. A narrow location, during the passage through which the conveying elements are displaced radially inward toward the rotation axis to the greatest extent is located between a pressure region and a subsequent intake region when viewed in the working rotation direction of the vane cell pump.

The rotor has, radially inside the conveying elements, expulsion regions which are at least partially connected to at least one pressure region via a fluid path in order to expel the conveying elements against the inner peripheral face of the contour ring.

The hydraulic vane cell pump is distinguished by an auxiliary start contour which is arranged between the rotation axis and the inner peripheral face radially inside the conveying elements in the region of at least one pump portion and which displaces the conveying element by applying only a part-stroke into the pump portion radially away from the rotation axis as a result of a maximum of temporary contact with a conveying element which is previously displaced at a narrow location to the greatest extent radially inwardly toward the rotation axis and which is thereby moved in.

In this case, the auxiliary start contour is preferably constructed in such a manner that it can move into contact with a conveying element only when it is already located in the pump portion and is still completely moved in.

In a particularly preferable manner, a conveying element which is displaced against the inner peripheral face of the contour ring is free from contact with the auxiliary start contour in principle.

The contact between the auxiliary start contour which is provided radially inside the conveying elements and a conveying element takes place at a side of the conveying element facing the rotation axis.

The auxiliary start contour is arranged so as to be non-rotatable with respect to the contour ring. The mechanical inner ring makes only the initial movement for the hydraulic under-vane cell pump. Oil is drawn under the conveying elements, whereby the conveying elements can be slightly lifted in the pressure region.

The auxiliary start contour can be constructed on an auxiliary start ring which is arranged so as to be non-rotatable with respect to the contour ring and/or can be included thereby and/or can include it.

It can be seen that the first aspect of subject-matter of the invention can be carried out by an auxiliary start ring which is constructed as a guiding ring and which, as a result of temporary contact during start problems, mechanically pushes out exclusively completely moved-in conveying elements for a part-stroke and which, after the start operation of the vane cell pump, if the conveying elements in the at least one pump portion are displaced over an entire rotor rotation completely against the inner peripheral face of the contour ring and the conveying elements are accordingly located hydraulically in full-stroke, loses the contact thereof so that the conveying elements during normal operation after the start operation are pressed only by their own centrifugal force and by the pump pressure in a manner driven hydraulically radially outward against the inner peripheral face of the contour ring.

A second aspect of subject-matter of the invention relates to a method for operating a hydraulic vane cell pump which has been, for example, described above. The method makes provision for at least the conveying elements which are still completely moved in during a rotation of the rotor after the introduction thereof into a pump portion, for example, by means of a ramp-like auxiliary start contour, which is provided within the rotational angular range of the pump portion and which is intended to be overcome during a rotation of the rotor from a side facing away from the inner peripheral face of the contour ring thereof without the use of a resilient loading or free from a resilient loading in order to redirect a part-stroke in the direction toward the inner peripheral face of the contour ring.

Accordingly, only at most the conveying elements which are not yet displaced against the inner peripheral face of the contour ring within a pump portion are forcibly redirected according to the invention.

A conveying element which is displaced against the inner peripheral face of the contour ring is in principle free from forced redirection.

The mechanically forced movement of the conveying elements is carried out during the start while the operation of the pump is carried out completely hydraulically.

The inner ring serves to mechanically lift the vanes. The inner ring lifts the vane; the outer ring moves the vane inward, which results in a mechanically forced movement. This movement is used in particular during a part-stroke.

During normal operation, the pump runs in a completely hydraulic manner and the conveying elements run in a state pressed against the contour and the inner ring is not in operation.

The conveying elements are already in the moved-in state in a position which is nearer the contour of the contour ring so that a more rapid starting with a smaller stroke is possible.

Since no additional component is required in the pump, the small construction space of the inner ring is advantageous and can also be fitted in the structural space of a conventional pump.

The inner ring can be fitted in one or both side plate(s).

The start device functions in a self-sufficient manner. No peripheral conditions of the consumer system, for example, a gear mechanism, are necessary.

The part-stroke which is mentioned both in connection with the hydraulic vane cell pump and with the method differs in this instance from a full stroke in that during the full stroke a conveying element is displaced away from the rotation axis radially so far that it closely abuts the inner peripheral face of the contour ring or runs thereon. The forced redirection via a part-stroke displaces the conveying element only radially away from the rotation axis so that it can no longer dwell in the completely moved-in position as a result of a preceding narrow location but without it moving into abutment with the inner peripheral face of the contour ring.

Both the vane cell pump and the method can alternatively or additionally have individual features or a combination of a plurality of features which are described in the introduction in connection with the prior art and/or in one or more of the documents which are mentioned in relation to the prior art and/or in the following description in relation to the embodiments which are illustrated in the drawings.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

The invention is explained in greater detail below with reference to embodiments which are illustrated in the drawings. The size ratios of the individual elements relative to each other in the Figures do not always correspond to the real size ratios because some forms are illustrated in a simplified state and other forms are illustrated in an enlarged state in relation to other elements for better illustration. Identical reference numerals are used for identical or identically operating elements of the invention. Furthermore, for the sake of clarity only reference numerals which are necessary for the description of the respective Figure are illustrated in the individual Figures. The embodiments illustrated are merely examples as to how the invention can be constructed and do not constitute a conclusive delimitation. In the schematic drawings:

Figure 6:
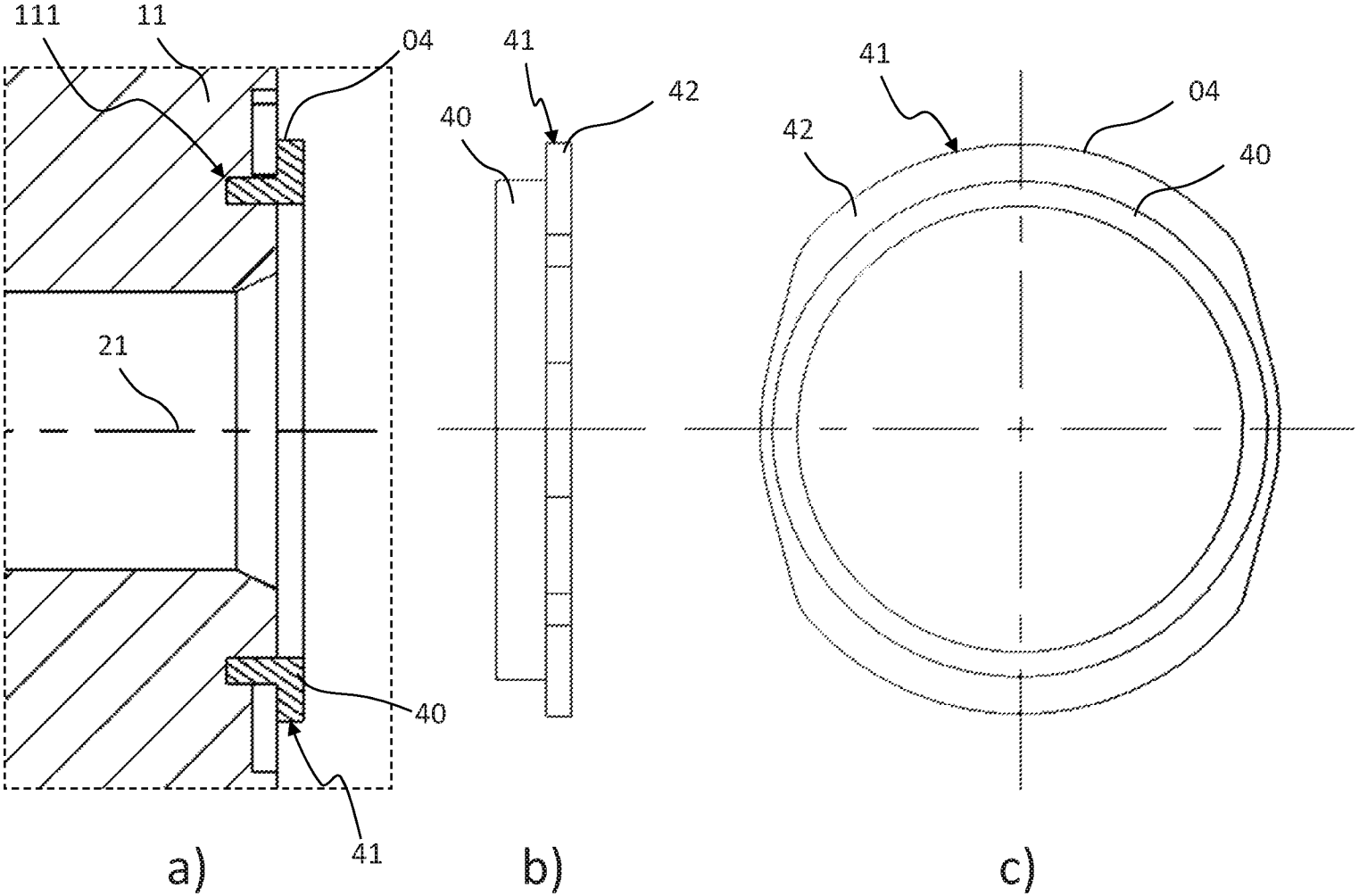

FIG. 6 shows an embodiment of an auxiliary start contour which is constructed on an outer peripheral face of an auxiliary start ring which is arranged on a side plate radially within the conveying elements of a hydraulic vane cell pump as a longitudinal section which extends about the rotation axis of the rotor thereof in FIG. 6*a*), as a side view in FIG. 6*b* and as a plan view when viewed along the rotation axis in FIG. 6*c*).

Figure 7:
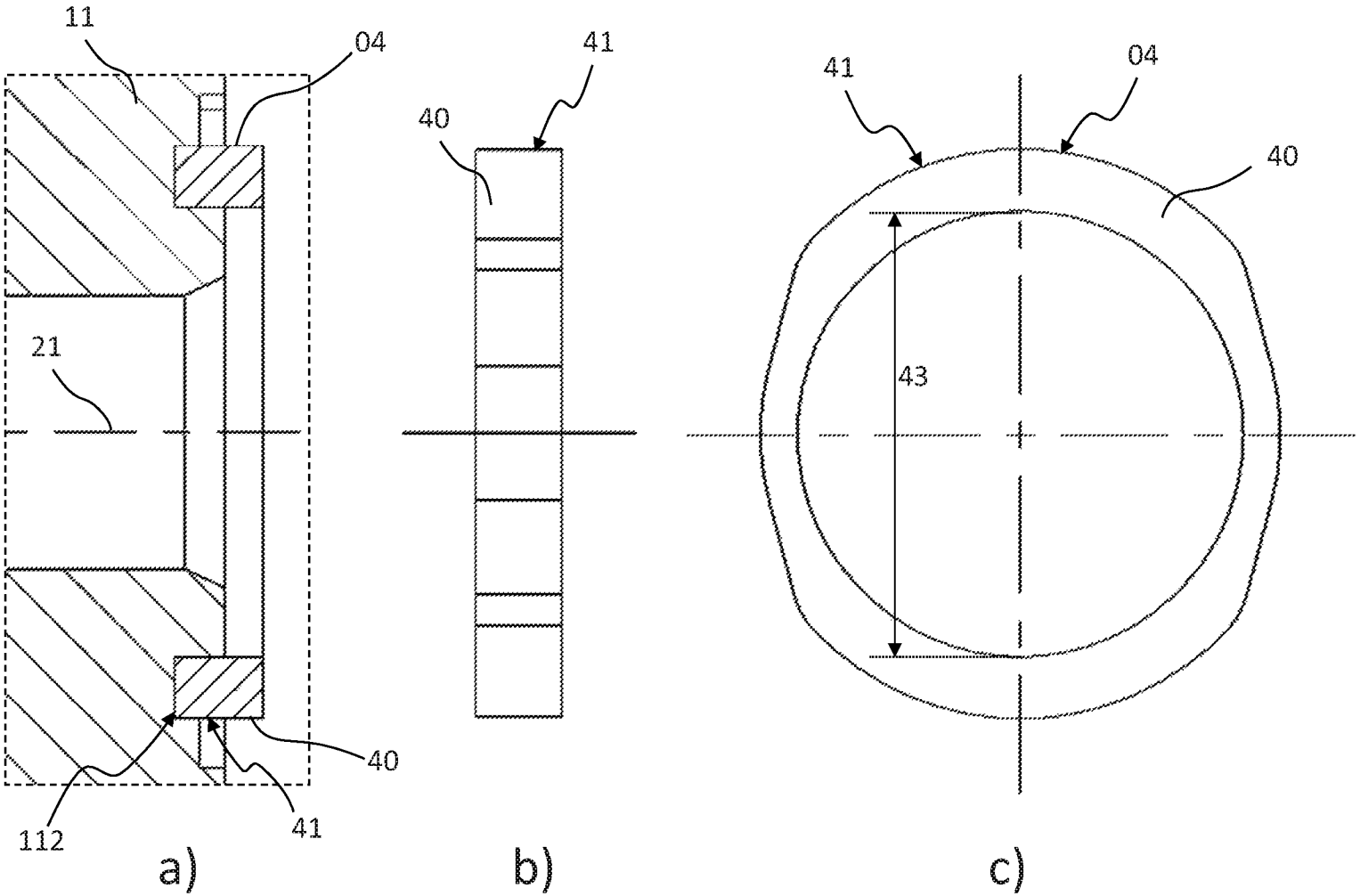

FIG. 7 shows another embodiment of an auxiliary start contour which is constructed on an outer peripheral face of an auxiliary start ring which is arranged on a side plate radially within the conveying elements of a hydraulic vane cell pump as a longitudinal section which extends about the rotation axis of the rotor thereof in FIG. 7*a*), as a side view in FIG. 7*b* and as a plan view when viewed along the rotation axis in FIG. 7*c*).

Figure 8:
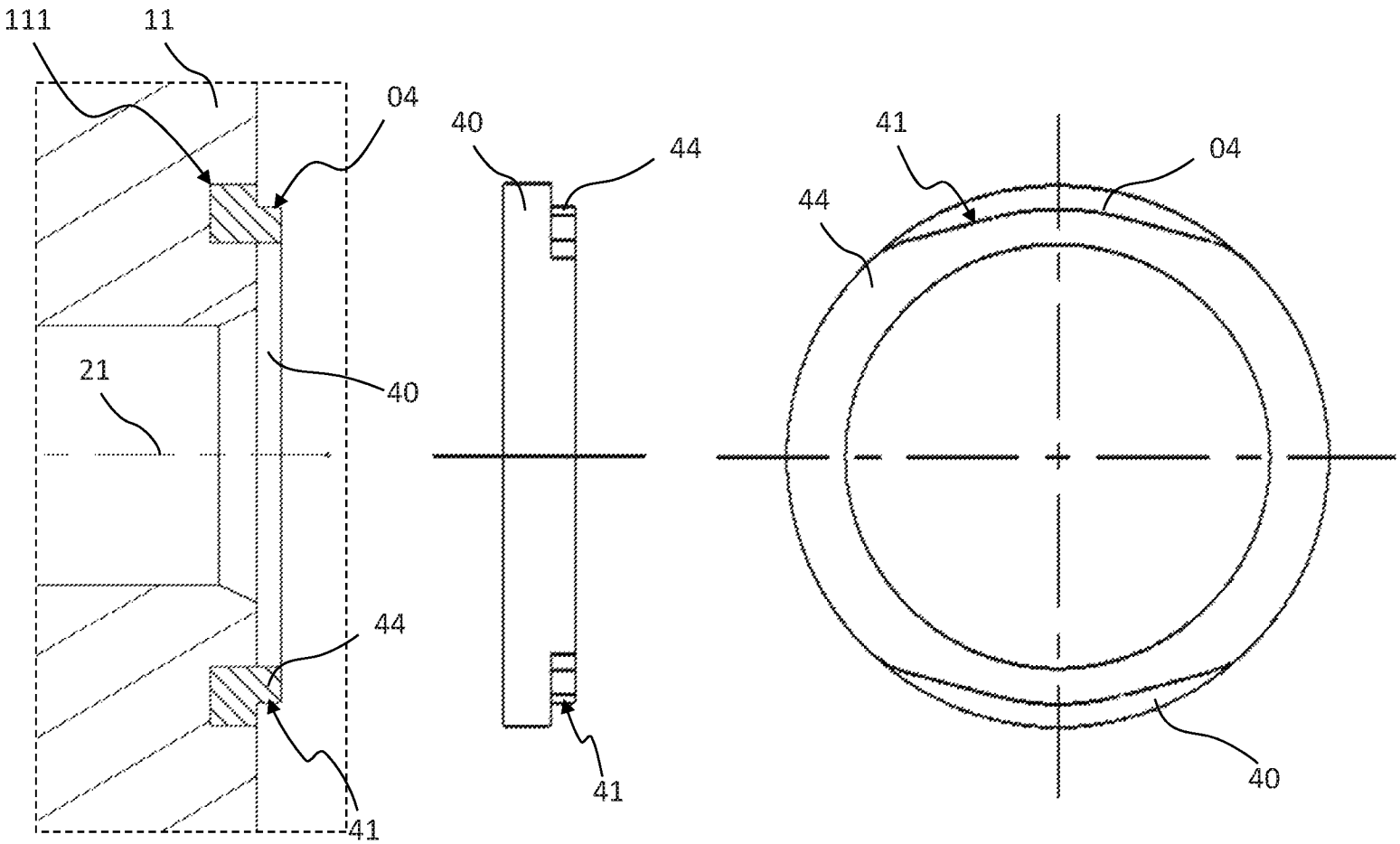

FIG. 8 shows another embodiment of an auxiliary start contour which is constructed on an outer peripheral face of an auxiliary start ring which is arranged on a side plate radially within the conveying elements of a hydraulic vane cell pump as a longitudinal section which extends about the rotation axis of the rotor thereof in FIG. 8*a*), as a side view in FIG. 8*b* and as a plan view when viewed along the rotation axis in FIG. 8*c*).

Figure 9:
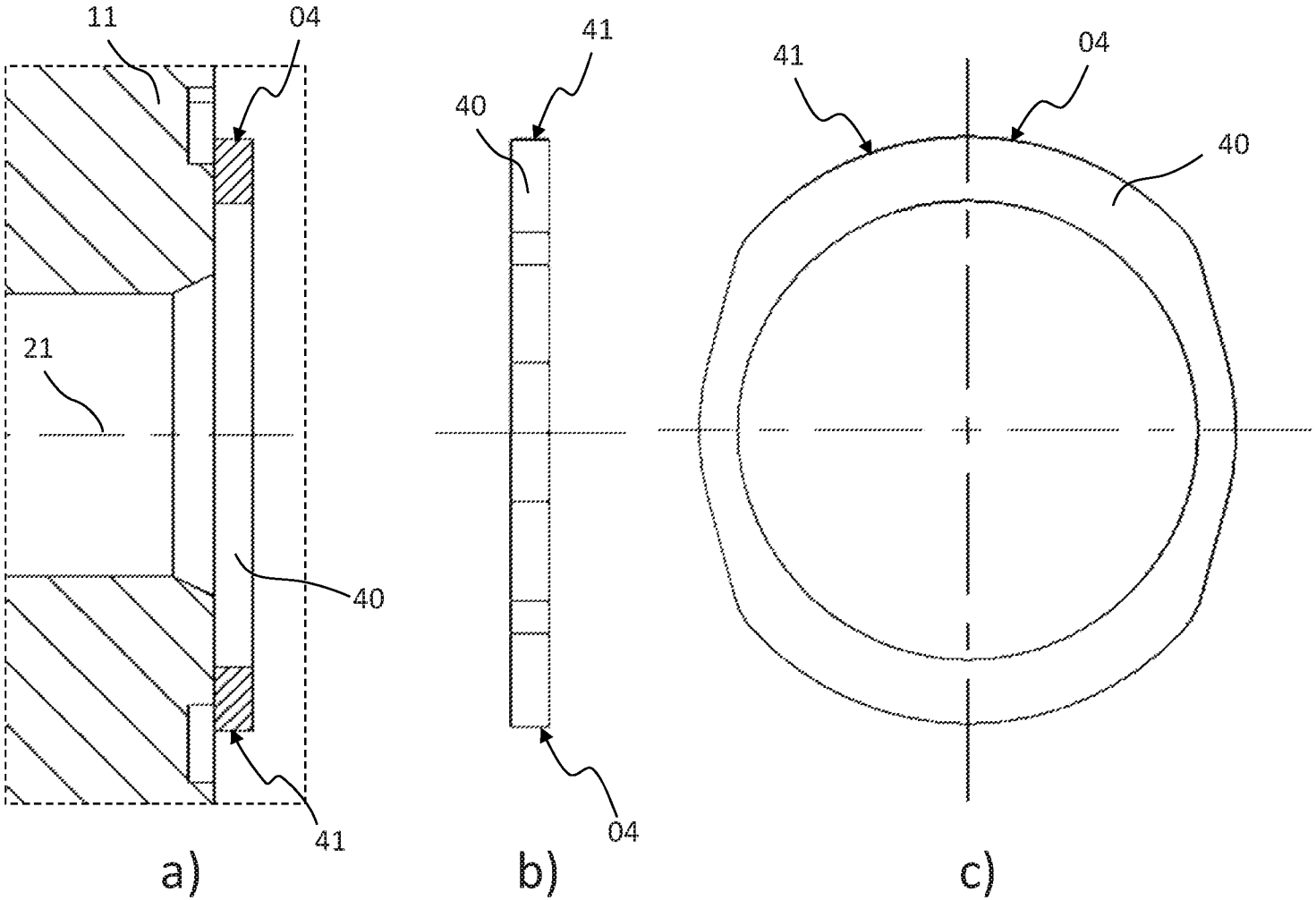

FIG. 9 shows an additional embodiment of an auxiliary start contour which is constructed on an outer peripheral face of an auxiliary start ring which is arranged on a side plate radially within the conveying elements of a hydraulic vane cell pump as a longitudinal section which extends about the rotation axis of the rotor thereof in FIG. 9*a*), as a side view in FIG. 9*b* and as a plan view when viewed about the rotation axis in FIG. 9*c*).

DETAILED DESCRIPTION

A vane cell pump 01 illustrated completely or partially in FIGS. 1 to 9 comprises:

- a hollow-cylindrical contour ring 10 which is arranged between two side plates 11, 12 and which has an inner peripheral face 100 and
- a rotor 22 which is rotatably supported about a rotation axis 21 which extends parallel with the cylinder axis of the contour ring 10 and which has a plurality of conveying elements 20 which can be displaced radially relative to the rotation axis 21 and which are urged against the inner peripheral face 100 during a rotation of the rotor 22.

The rotation axis 21 of the rotor 22 is a geometric axis. The rotor 22 may, for example, be rotatably supported on a shaft which extends along such a geometric axis or on one of the two side plates 11, 12 or on both of the side plates 11, 12, or it can be connected to a shaft which is supported about such a geometric axis and which extends along this axis.

The inner peripheral face 100 is constructed in such a manner that a number corresponding to the number of flows of the vane cell pump 01 of preferably sickle-like conveying chambers 03 which each form a pump portion 31, 32 are constructed so as to have an intake region 33 and a pressure region 34, respectively, which are passed through by the conveying elements 20 during a rotation of the rotor 22.

The vane cell pump 01 can be constructed with one or more flows, for example, with two flows as illustrated in FIG. 2, FIG. 3, FIG. 4, FIG. 5.

The vane cell pump 01 can be constructed with a multiple-flow configuration, for example, so as to be able to be switched in accordance with temperature.

Within a pump portion 31, 32, the radial spacing between the rotation axis 21 and the inner peripheral face 100 of the contour ring 10 continuously increases when viewed in a working rotation direction of the rotor 22 of the vane cell pump 01 as indicated by an arrow P in FIG. 2, FIG. 3, FIG. 4, FIG. 5 over the intake region 33 initially toward approximately the center of the pump portion 31, 32 in order subsequently to continuously decrease toward the end of the pressure region 34 again.

A narrow location 30 is located between a pressure region 34 and an intake region 33 which is successive when viewed in a working rotation direction of the rotor 22 of the vane cell pump 01 as indicated by the arrow P in FIG. 2, FIG. 3, FIG. 4, FIG. 5. The narrow location 30 is distinguished by a minimum spacing in a rotation angle or over a rotational angular range between the rotation axis 21 and the inner peripheral face 100 of the contour ring 10. During the passage through a narrow location 30, the conveying elements 20 are displaced radially inward toward the rotation axis 21 to the greatest extent.

The rotor 22 has expulsion regions 200 which are indicated by discontinuously illustrated delimitations radially within the conveying elements 20 in FIG. 2, FIG. 3, FIG. 4, FIG. 5 and which are at least partially connected to at least one pressure region 34 via a fluid path 35 in order to expel the conveying elements 20 hydraulically against the inner peripheral face 100 of the contour ring 10.

The expulsion regions 200 extend in a preferably radial direction within an annular portion of the rotor 22 which is delimited in a radial direction outward by an outer diameter of the rotor 22 which is indicated by an outer circle 222 which is illustrated in FIG. 2, FIG. 3, FIG. 4, FIG. 5. In an inward direction, the portion is delimited by an inner portion 351 of the fluid path 35, which inner portion is provided in the rotor 22 within an inner circle 221 illustrated in FIG. 2, FIG. 3, FIG. 4, FIG. 5 and communicates with a remaining portion 352 of the fluid path 35 over at least a portion of the rotor rotation, which portion 352 is provided in one or both side plates 11, 12. The diameter of the inner circle 221 is smaller at least by double the radial extent of the conveying elements 20 than the outer diameter of the rotor 22, which outer diameter is indicated in a simplified manner by the outer circle 222 in FIG. 2, FIG. 3, FIG. 4, FIG. 5.

The conveying elements 20 are freely movable within the expulsion regions 200 in the direction of the extent thereof. The movability outward in a radial direction is limited by the inner peripheral face 100 of the contour ring. The movability inward in a radial direction is limited by the inner portion 351 of the fluid path 35 located inside the diameter of the inner circle 221.

The vane cell pump 01 is distinguished by an auxiliary start contour 04 which is arranged between the rotation axis 21 and the inner peripheral face 100 radially within the conveying elements 20 in the region of at least one pump portion 31, 32.

The auxiliary start contour 04 is arranged so as to be non-rotatable relative to the contour ring 10.

The auxiliary start contour 04 displaces conveying elements 20 which are displaced at least previously at a narrow location 30 to the greatest extent radially inward toward the rotation axis 21 and which are thereby moved into the rotor 22 by applying only a part-stroke radially away from the rotation axis 21 into the pump portion 31, 32 which follows the narrow location 30.

This displacement is carried out by a maximum of temporary contact between a conveying element 20, which has been displaced previously at a narrow location 30 at least to the greatest extent radially inward toward the rotation axis 21, and the auxiliary start contour 04.

The part-stroke mentioned differs from a full stroke in that during the full stroke a conveying element 20 is displaced radially away from the rotation axis 21 so far that it is closely in abutment or runs against the inner peripheral face 100 of the contour ring 10. The forced redirection by a part-stroke displaces the conveying element 20 only over a portion of the spacing between the outer diameter of the rotor 22 and the inner peripheral face 100 of the contour ring 10 radially away from the rotation axis 21, which outer diameter is indicated by the outer circle 222 in a simplified manner in FIG. 2, FIG. 3, FIG. 4, FIG. 5, so that it can no longer dwell in the position which is completely moved-in as a result of a preceding narrow location 30, but without abutment against the inner peripheral face 100 of the contour ring 10 being produced.

As a result of the part-stroke, the release of the affected conveying element 20 from the static friction or similar inhibiting effects is already brought about.

Figure 1:
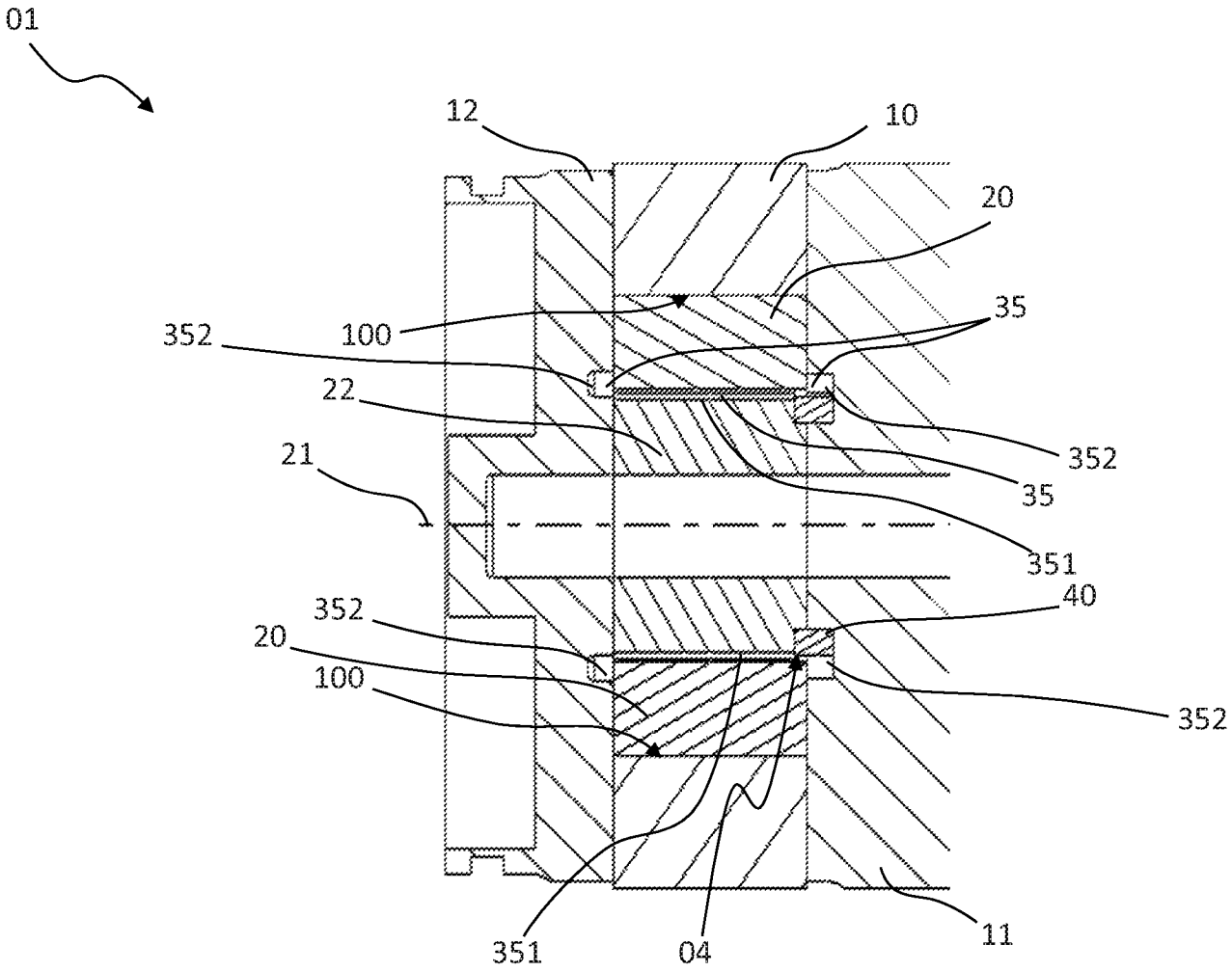
FIG. 1 shows a first embodiment of a hydraulic vane cell pump as a longitudinal section extending about the rotation axis of the rotor thereof.
Figure 2:
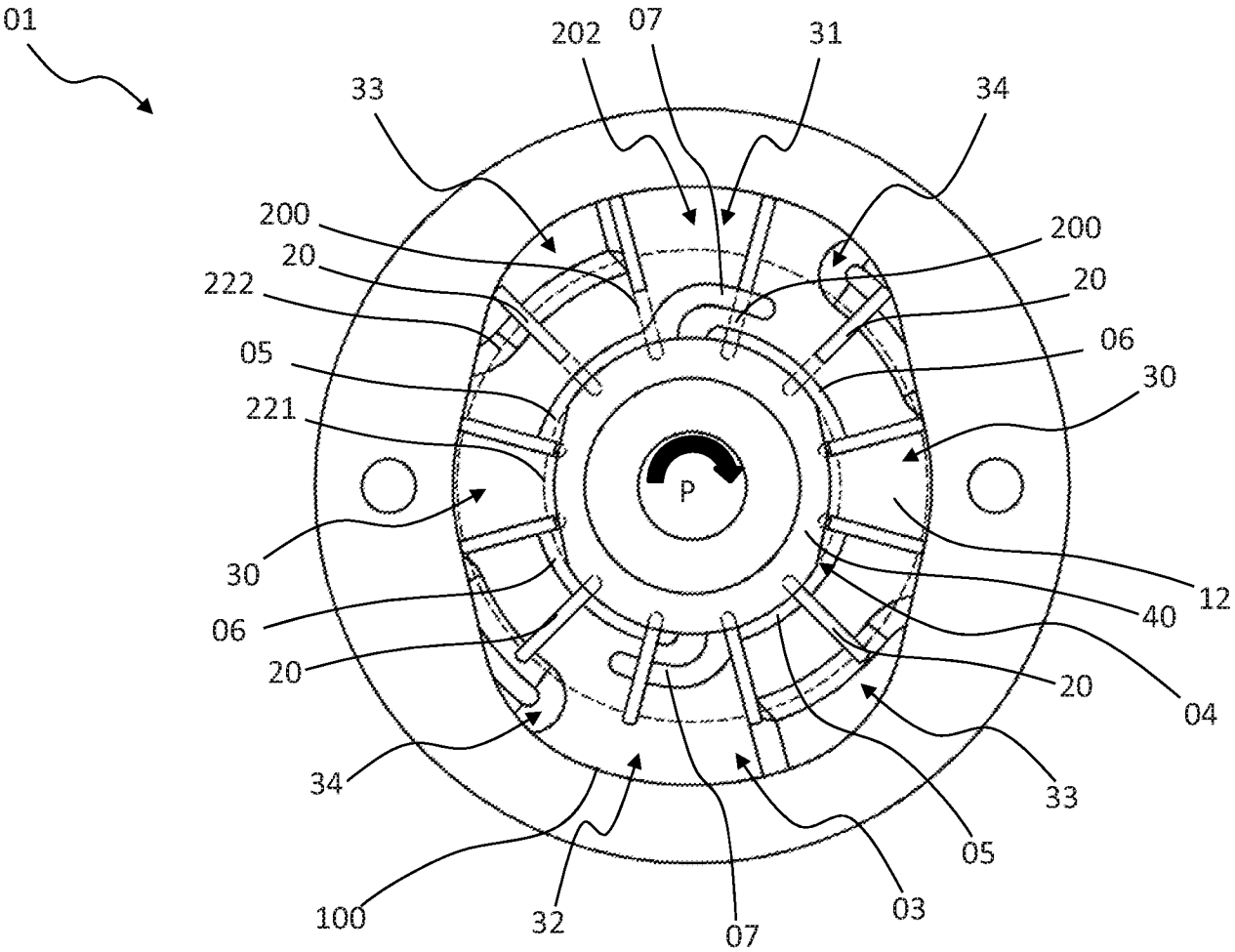
FIG. 2 shows a second embodiment of a hydraulic vane cell pump having a collection groove as a cross-section which extends normally relative to the rotation axis of the rotor thereof between the side plate thereof facing the observer and the contour ring thereof.

An additional advantage is produced in connection with a vane cell pump 01 which is provided with a collection groove 05, as illustrated in FIG. 2, in the intake region 33 and/or with a collection groove 06 in the pressure region 34 of at least one pump portion 31, 32.

As a result of the auxiliary start contour 04, moved-in conveying elements 20 are subjected at the start of the vane cell pump 01 to a part-stroke or they remain partially moved out during the part-stroke if they have been drawn back during stoppage inside a pump portion 31, 32 into the expulsion regions 200 associated therewith. A conveying element 20 which is moved out by a part-stroke travels over the collection groove 05 which is, for example, constructed as an under-vane groove, in the intake region 33 when the pump is started. Fluid is thereby drawn in the collection groove 05 which is located under the conveying element 20. During the subsequent rotational movement, this drawn-in fluid is transported into the closed region of a collection groove 06 which is constructed, for example, as an under-vane groove in the pressure region 34. This collection groove 06 in the pressure region 34 forms a portion of the fluid path 35 and/or communicates with the fluid path 35. The collection groove 06 in the pressure region 34 preferably at least partially comprises the remaining portion 352 of the fluid path 35 or is included thereby at least partially.

Since this region in which the collection groove 06 in the pressure region 34 is located is closed at least toward the end of the pressure region 34 when the conveying elements 20 which were previously moved out only by a part-stroke are located in a rotational angular range in which the auxiliary start contour 04 has already jumped back again toward the rotation axis in the working rotation direction indicated by the arrow P, by the inner peripheral face 100 of the contour ring 10 move into abutment against the inner peripheral face 100, which inner peripheral face also jumps back in the direction toward the rotation axis, and the conveying elements 20 move in again as a result of the contact with the inner peripheral face 100, a fluid volume accumulates here.

A pressure build-up already thereby takes place and expels the conveying elements 20 which are retracted in the expulsion regions 200 further beyond the part-stroke which is brought about mechanically by means of the contact between the auxiliary start contour 04 and the relevant conveying elements 20.

The conveying elements 20 are now moved in the pressure region 34 against the inner peripheral face 100. If a conveying element 20 in the separation region between the intake region 33 and the pressure region 34 of a pump portion 31, 32 reaches the inner peripheral face 100, the vane cell pump 01 begins to convey. The lower edge of the separating conveying element 20 can now open, as in the vane cell pump 01 illustrated in FIG. 2, the closed collection groove 06 of the pressure region relative to a parallel channel 07 which has a connection to the intake side of the vane cell pump 01. In this start state, the vane cell pump 01 can convey liquid and gaseous fluid, for example, lubrication oil and air. This is a stable state and can thus last as long as necessary without initially pressure being produced in the system. Generally, there are a small number of revolutions.

If the vane cell pump 01 has conveyed away the air and a gear mechanism which is, for example, connected thereto is supplied with oil, the system pressure builds up. With this pressure, the conveying elements 20 in the intake region 33 also begin to move toward the inner peripheral face 100. The vane cell pump 01 now runs in a purely hydraulic manner as usual. The auxiliary start contour 04 is then out of operation.

The auxiliary start contour 04 is accordingly used only for a mechanical initial start operation.

In the embodiment which is illustrated in FIG. 2 and which, with the side plate 12 facing the observer being removed, releases the view toward the side facing the conveying chambers 03 in respect of the side plate 12 facing away from the observer, the opposite side plate 11 can be constructed identically.

Figure 3:
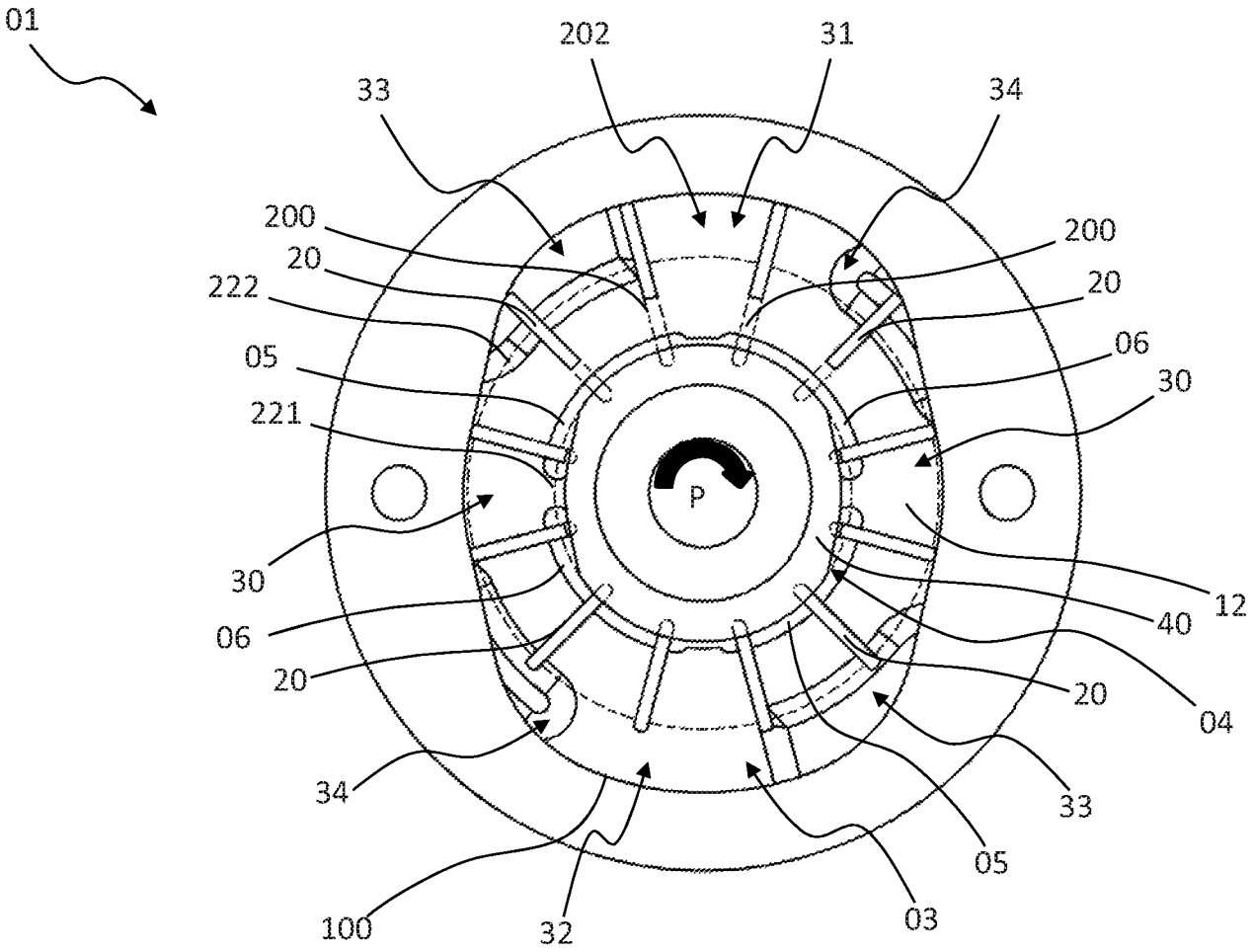
FIG. 3 shows a third embodiment of a hydraulic vane cell pump as a cross-section which extends normally relative to the rotation axis of the rotor thereof between the side plate thereof facing the observer and the contour ring thereof.

In the embodiment which is illustrated in FIG. 3 and which, with the side plate 12 facing the observer being removed, releases the view toward the side facing the conveying chambers 03 in respect of the side plate 12 facing away from the observer, a four-fold separation is provided on the opposite side plate 11.

Figure 4:
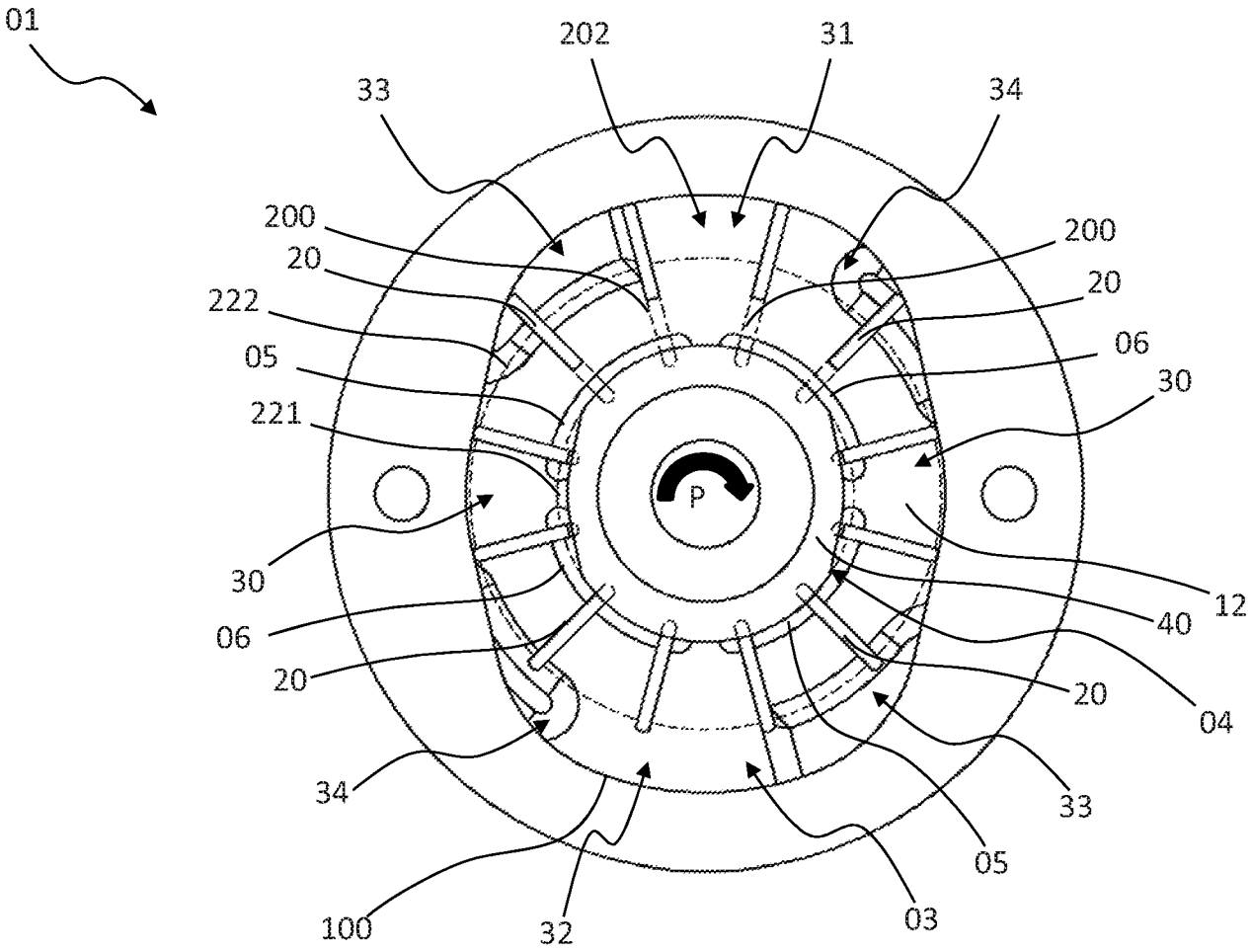
FIG. 4 shows a fourth embodiment of a hydraulic vane cell pump as a cross-section which extends normally relative to the rotation axis of the rotor thereof between the side plate thereof facing the observer and the contour ring thereof.

In the embodiment which is illustrated in FIG. 4 and which, with the side plate 12 facing the observer being removed, releases the view toward the side facing the conveying chambers 03 in respect of the side plate 12 facing away from the observer, an annular groove is provided on the opposite side plate 11.

Figure 5:
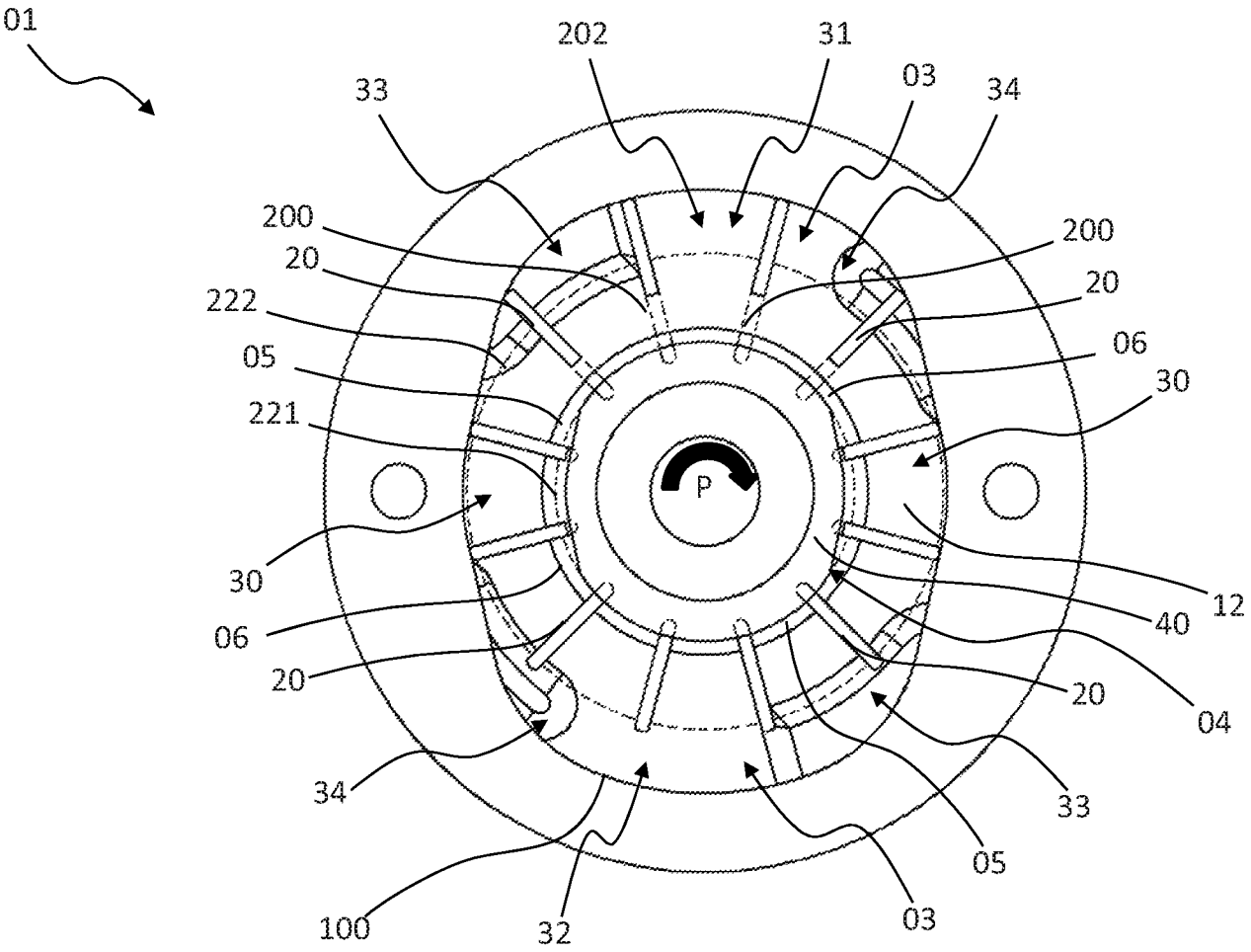
FIG. 5 shows a fifth embodiment of a hydraulic vane cell pump as a cross-section which extends normally relative to the rotation axis of the rotor thereof between the side plate thereof facing the observer and the contour ring thereof.

In the embodiment which is illustrated in FIG. 5 and which, with the side plate 12 facing the observer being removed, releases the view toward the side facing the conveying chambers 03 in respect of the side plate 12 facing away from the observer, a four-fold separation is constructed on the opposite side plate.

The auxiliary start contour 04 is preferably constructed in such a manner that it moves and/or can move into contact with a conveying element 20 only when it, when viewed from the rotation axis 21, is already located in a rotational angular range which is within a pump portion 31, 32 and which is still completely moved in. A conveying element 20 which is displaced against the inner peripheral face 100 of the contour ring 10 is in principle free from contact with the auxiliary start contour 04.

The contact between the auxiliary start contour 04 which is provided radially within the conveying elements 20 and a conveying element 20 takes places preferably at a side of the conveying element 20 facing the rotation axis 21.

In principle, it is also conceivable to provide the conveying elements 20 with grooves or projections at narrow sides which face one of the side plates 11, 12 and which then cooperate with an auxiliary start contour which is formed in one of the side plates 11, 12 or which is arranged therein.

The auxiliary start contour 04 may be similar to the inner peripheral face 100 of the contour ring 10 in a mathematical sense, wherein the same spacing is present between the auxiliary start contour 04 and the inner peripheral face at any rotational angle of the rotor 22 when viewed from the rotation axis 21 toward the inner peripheral face 100 of the contour ring 10.

Alternatively, it is conceivable for there to be per pump portion 31, 32 a maximum of two rotational angles of the rotor 22, at which the same spacing between the auxiliary start contour 04 and the inner peripheral face 100 of the contour ring 10 is present when viewed from the rotation axis 21 toward the inner peripheral face 100 of the contour ring 10.

In this case, different spacings between the auxiliary start contour 04 and the inner peripheral face 100 of the contour ring 10 are present within each intake region 33 and within each pressure region 34 when viewed from the rotation axis 21 in a radial direction.

In a particularly preferable manner, the auxiliary start contour 04 is constructed at least at a portion of an outer peripheral face 41 of an auxiliary start ring 40 which is arranged so as to be non-rotatable relative to the contour ring 10 and radially within the conveying elements 20 and/or is included thereby and/or includes it.

When viewed from the rotation axis 21 toward the inner peripheral face 100 of the contour ring 10, in this instance the spacing between the auxiliary start contour 04 of the outer peripheral face 41 of the auxiliary start ring 40 and the inner peripheral face 100 of the contour ring 10 preferably has such dimensions at each rotational angle of the rotor 22 that a conveying element 20 which is urged against the inner peripheral face 100 of the contour ring 10 is free from any contact with the auxiliary start contour 04 at the outer peripheral face 41 of the auxiliary start ring 40. A conveying element 20 which is radially urged away from the rotation axis 21 by the outer peripheral face 41 of the auxiliary start ring 40 does not come into contact with the inner peripheral face 100 of the contour ring 10 while it is still in contact with the auxiliary start contour 04.

In the embodiment illustrated in FIG. 6, the auxiliary start ring 40 is provided with a shoulder 42 which has the portion of the outer peripheral face 41 which is provided with the auxiliary start contour 04. The auxiliary start ring 40 is arranged by means of a circular undercut 111 in the flange facing the contour ring 10 at a side plate 11.

In the embodiment illustrated in FIG. 7, the auxiliary start ring 40 is constructed so as to have a uniform cross-section over the entire extent thereof along the rotation axis 21. The entire outer peripheral face 41 thereof is provided with the auxiliary start contour 04. The auxiliary start ring 40 is arranged in the flange facing the contour ring 10 on a side plate 11 by means of a contoured groove 112 which is constructed in an annular manner in an inward direction toward the rotation axis 21, for example, in accordance with the inner diameter 43 of the auxiliary start ring 40 and which corresponds with the auxiliary start contour 04 in an outward direction away from the rotation axis 21.

In the embodiment illustrated in FIG. 8, the auxiliary start ring 40 is provided with a shoulder 44 which has the portion of the outer peripheral face 41 which is provided with the auxiliary start contour 04. The auxiliary start ring 40 is arranged by means of a circular undercut 111 in the flange facing the contour ring 10 at a side plate 11. The shoulder 44 is produced by material cutouts in a circular ring unlike the embodiment in FIG. 6 in which the annular portion provided for being received in the circular undercut 111 is produced by material cutouts in a ring which is annular in an inward direction but which is in the form of an auxiliary start contour in an outward direction.

In the embodiment illustrated in FIG. 9, the auxiliary start ring 40 is constructed as a contour disk which is arranged on the running face, which faces the inner pump chamber which accommodates the rotor 22, for the conveying elements 20. The auxiliary start ring 40 is constructed so as to have a uniform cross-section over the entire extent thereof about the rotation axis 21. The entire outer peripheral face 41 thereof is provided with the auxiliary start contour 04.

It can be seen that the object forming the basis of the invention can be achieved by an auxiliary start ring 40 which is constructed as an inner ring and which is fixed in a rotationally secure manner in at least one of the side plates 11, 12 of the vane cell pump 01. As a result of the auxiliary start contour 04 which is constructed at least at a portion of the outer peripheral face 41 of the auxiliary start ring 40, the conveying elements 20 are mechanically pushed out at the start of the vane cell pump 01, wherein they are not guided as far as the inner peripheral face 100 of the contour ring 10. As a result of this part-stroke, on the one hand, it is ensured that

- there is produced a release of relevant conveying elements 20 from static friction or similar impeding effects,
- the necessary remaining stroke is reduced,
- in conjunction with a collection groove 05, which is constructed, for example, as an under-vane collection groove in the intake region 33 of at least one pump portion 31, 32, it already draws in fluid and During normal operation, after the start operation, the auxiliary start ring 40 and the auxiliary start contour 04 which is constructed at least at one portion of the outer peripheral face 41 thereof does not have any more influence on the pump function.

It is important to emphasize that the auxiliary start contour 04 can be provided on or in at least one side plate 11, 12.

Accordingly, the auxiliary start contour 04 can itself be constructed directly on one of the side plates 11, 12 or on both side plates 11, 12 or an auxiliary start ring 40, for example, on at least a portion of the outer peripheral face 41 of which the auxiliary start contour 04 is constructed, can be arranged on one of the two side plates 11, 12, or two auxiliary start rings 40, on at least a portion of the outer peripheral faces 41 of which the auxiliary start contour 04 is constructed can be arranged on both side plates 11, 12, for example, on both auxiliary start rings 40 completely or only partially, so that the two portions supplement each other, an auxiliary start ring 40 on one of the two side plates 11, 12, respectively.

Advantages over the prior art are reduced inner losses during continuous operation because the conveying elements 20 have to be urged back by the inner peripheral face 100 only counter to the centrifugal force thereof radially relative to the rotation axis 21.

Furthermore, the wear is reduced because the conveying elements 20 are not pressed as in the prior art either in a resiliently loaded manner against the inner peripheral face 100 or wherein they are pressed in each pump portion by the control cam radially away from the rotation axis completely against the inner peripheral face and urged back in each narrow location by the inner peripheral face in the same manner against the control cam in the direction radially toward the rotation axis. The vanes are securely retained hydraulically on the contour.

Advantages which result in addition to a complete achievement of the object set out by overcoming all the disadvantages of the prior art are inter alia a capacity for implementation simply using an additional component—an auxiliary start ring 40 which is arranged on one of the two side plates 11, 12—and/or by carrying out only one additional working step—of constructing the auxiliary start contour on one of the two side plates 11, 12—in a small construction space with only small adaptations of the side plates 11, 12, pump plates and the rotor 22 and/or the conveying elements 20. At the system side, at the side of a device which is intended to be supplied with the fluid to be conveyed, for example, a drive mechanism or a motor of a vehicle, no steps are necessary in order to use the vane cell pump 01 according to the invention instead of a vane cell pump according to the prior art.

Even if the vane cell pump 01 is only wetted with oil and otherwise is filled with air, the solution according to the invention operates without any additional measure at the pump or system side during cold starts.

This start behavior is not known from any other solution. Furthermore, all other solutions known from the prior art are substantially more intensive in terms of structural space and costs.

These include, for example:

- cold start plate. A disadvantage therein is that the hydraulic action is not ensured in an unlimited manner if the pump is run at no-load and/or the conveying elements which are referred to briefly as vanes are not located at the inner peripheral face of the contour ring, which is referred to briefly as the stroke ring contour. Additional structural space is required. Loss of power occurs as a result of the additional valve resistance.
- Siphon against no-load operation of the pump. A disadvantage therein is the high structural spatial requirement and an ineffectiveness during a second start when the pump has previously drawn in a large quantity of air.
- Increase of the vane slot play. The significant disadvantage therein is a great leakage which results in high volumetric losses.
- Mechanical vane guiding. This produces great leakages in principle and therefore volumetric losses. Furthermore, additional structural space is required therefor.

A method which also completely achieves the object set by overcoming all the disadvantages of the prior art and by achieving all the above-mentioned advantages for operating a vane cell pump 01, for example, described above makes provision for at least the conveying elements 20, which in the event of a rotation of the rotor 22 after the introduction thereof into a pump portion 31, 32, that is to say, if they already travel over or pass through a pump portion 31, 32, to be still completely moved in, for example, by means of a ramp-like auxiliary start contour 04 which is intended to be overcome from a side which faces away from the inner peripheral face 100 of the contour ring 10 thereof during a rotation of the rotor 22 and which is provided within the rotational angular range of the pump portion 31, 32 without the use of a resilient loading or free from a resilient loading in order to forcibly redirect a part-stroke in the direction toward the inner peripheral face 100 of the contour ring 10.

The part-stroke mentioned also differs in this case from a full stroke as already set out above in relation to the vane cell pump.

Preferably, only a maximum of the conveying elements which are not yet displaced against the inner peripheral face 100 of the contour ring 10 within a pump portion 31, 32 are forcibly redirected.

In principle, however, a conveying element 20 which is displaced against the inner peripheral face 100 of the contour ring 10 is free from forced redirection.

It is important to emphasize that the vane cell pump 01 and the method alternatively or additionally may have individual features or a combination of a plurality of features which are described:

in the introduction in connection with the prior art and/or in one or more of the documents which are mentioned in relation to the prior art and/or in the above description including the description belonging to the embodiments illustrated in the drawings.

The invention is not limited by the description with reference to the embodiments. Instead, the invention includes any new feature and any combination of features which contains in particular any combination of features in the claims even if this feature or this combination itself is not explicitly set out in the claims or embodiments.

The invention can be commercially applied in particular in the field of production of vane cell pumps, for example, lubrication oil pumps, in particular of gear pumps and/or engine oil pumps.

The invention has been described with reference to preferred embodiments. However, a person skilled in the art may envisage that modifications or changes to the invention can be made without in this case departing from the scope of protection of the appended claims.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A vane cell pump comprising a hollow-cylindrical contour ring which is arranged between two side plates and which has an inner peripheral face and a rotor which is rotatably supported about a rotation axis which extends parallel with a cylinder axis of the contour ring and which has a plurality of conveying elements which can be displaced radially relative to the rotation axis and which are urged against the inner peripheral face during a rotation of the rotor, wherein:

the inner peripheral face is formed to include a plurality of conveying chambers which each form a pump portion and each have an intake region and a pressure region which are passed through by the conveying elements during a rotation of the rotor;

within a pump portion, the radial spacing between the rotation axis and the inner peripheral face increases when viewed in the rotation direction of the rotor over the intake region in order subsequently to decrease toward the end of the pressure region again;

a narrow location, during the passage through which the conveying elements are displaced radially inward toward the rotation axis to the greatest extent, is located between a pressure region and a subsequent intake region when viewed in the rotation direction;

the rotor has, radially inside the conveying elements, expulsion regions which are at least partially connected to at least one pressure region via a fluid path in order to expel the conveying elements against the inner peripheral face;

an auxiliary start contour arranged between the rotation axis and the inner peripheral face radially inside the conveying elements in the region of at least one pump portion and which displaces the conveying element by applying only a part-stroke into the pump portion as a result of a maximum of temporary contact with a conveying element which is previously displaced at a narrow location to the greatest extent radially inwardly toward the rotation axis;

a first collection groove located in the intake region and a second collection groove located in the pressure region, wherein the conveying element which is moved out by the part-stroke travels over the first collection groove when the pump is started and fluid is thereby drawn-in the first collection groove, and wherein during subsequent rotational movement, the drawn-in fluid is transported into a closed region of the second collection groove in the pressure region; and an auxiliary start ring including an embedded segment axially embedded in at least one of the side plates and rotationally fixed to the at least one of the side plates, wherein the embedded segment extends about the rotation axis, and wherein at least a portion of the auxiliary start contour is defined by an outer peripheral face of the auxiliary start ring.

2. The vane cell pump as claimed in claim 1, wherein the conveying element moves into contact with the auxiliary start contour only when it is already located in the pump portion and is still completely moved in, whereas when the conveying element is displaced against the inner peripheral face, the conveying element is free from contact with the auxiliary start contour.

3. The vane cell pump as claimed in claim 1, wherein the contact between the auxiliary start contour which is provided radially inside the conveying elements and a conveying element takes place at a side of the conveying element facing the rotation axis.

4. The vane cell pump as claimed in claim 1, wherein the same spacing is present between the auxiliary start contour and the inner peripheral face at any rotational angle of the rotor when viewed from the rotation axis toward the inner peripheral face.

5. The vane call pump as claimed in claim 1, wherein the embedded segment has a ring-shape.

6. The vane cell pump as claimed in claim 5, wherein the embedded segment has a constant inside diameter.

7. The vane cell pump as claimed in claim 5, wherein the embedded segment has a constant outer diameter.

8. The vane cell pump as claimed in claim 5, wherein the auxiliary start ring further has a shoulder having an outer peripheral face defining the auxiliary start contour and located at least partially radially inwardly or outwardly relative to an outer circumference of the embedded segment.

9. The vane cell pump as claimed in claim 8, wherein the outer peripheral face is located at least partially radially outwardly relative to the outer circumference of the embedded segment.

10. The vane cell pump as claimed in claim 8, wherein the outer peripheral face is located at least partially radially inwardly relative to the outer circumference of the embedded segment.

* * * * *